United States Patent [19]

Drugge

[11] 4,321,085

[45] Mar. 23, 1982

[54] METHOD OF SINTERING PELLETS

[75] Inventor: Roland Drugge, Malmberget, Sweden

[73] Assignee: Loussavaara-Kiirunavaara Aktiebolag, Stockholm, Sweden

[21] Appl. No.: 114,693

[22] Filed: Jan. 23, 1980

[30] Foreign Application Priority Data

Feb. 6, 1979 [SE] Sweden ..... 7901052

[51] Int. Cl.[3] ..... C22B 1/20

[52] U.S. Cl. ..... 75/5

[58] Field of Search ..... 75/5, 34–37

[56] References Cited

U.S. PATENT DOCUMENTS

| | | | |
|---|---|---|---|
| 3,661,553 | 5/1972 | Frans | 75/3 |
| 4,023,963 | 5/1977 | Bonnaure | 75/35 |
| 4,168,951 | 9/1979 | Drugge | 432/13 |

FOREIGN PATENT DOCUMENTS

| | | |
|---|---|---|
| 55735 | 10/1921 | Sweden . |
| 396406 | 9/1977 | Sweden . |

OTHER PUBLICATIONS

Swedish Patent Application Ser. No. 7612793-5 and English Translation.

*Primary Examiner*—Michael L. Lewis

*Attorney, Agent, or Firm*—Fleit & Jacobson

[57] ABSTRACT

Green pellets are sintered by drying, pre-heating, firing and cooling steps, at least the drying and pre-heating steps being carried out with said pellets resting, in the form of a bed, on an endless gas-permeable conveyor and at least the first part of the drying operation being carried out with a gas which passes upwardly through said conveyor and the pellet bed, while subsequent temperature-increasing treatment steps carried out on the conveyor are effected with a hot gas flowing downwardly through the pellet bed and the conveyor. At least the first part of the drying operation is effected with heat stored in the conveyor and/or in a hearth layer for the pellet bed arranged on said conveyor by using a drying gas which comprises substantially cool air and which is heated during its passage through the conveyor and/or the hearth layer by the heat stored therein.

6 Claims, 2 Drawing Figures

METHOD OF SINTERING PELLETS

The present invention relates to a method of sintering green pellets, particularly iron ore pellets, comprising the steps of drying, pre-heating, firing and cooling said pellets, in which at least the drying and pre-heating steps are carried out with said pellets resting in the form of a bed on an endless gas-permeable conveyor, and in which at least the first part of the drying operation is effected with a gas passing upwardly through the conveyor and the pellet bed, while subsequent temperature-increasing treatment steps carried out on the conveyor are effected with a hot gas passing downwardly through the pellet bed and the conveyor.

Methods of the aforedescribed kind, which are known from, for example, the U.S. Pat. No. 4,168,951 have the disadvantage that the conveyor is heated considerably by the upwardly flowing gas in the pre-drying zone. Because of problem emanating from the relatively low mechanical strength of the green pellets, the drying gas, which is normally taken from the cooling zone, cannot be passed from above through the pellet bed. The temperature of the drying gas is normally about 300° C. and thus heats firstly the conveyor and, when located thereon, a hearth layer of, e.g., cold pellets which have already been sintered. This causes the upper part of the conveyor in the subsequent final-drying zone, the pre-heating zone and firing zone to have an excessively high temperature, so that said conveyor part and possible hearth layer are not able to cool the hot gases passing downwardly through the pellet bed and the conveyor to any appreciable extent, but that these gases are still of a relatively high temperature when they depart, which results in heat losses and which, in practice, requires the arrangement of cooling means upstream of at least the fans used to carry away the gases which have been utilized for the final-heating step and the firing step of the method. Cooling to a temperature of at most about 400° C. is required. Admittedly part of the gas thus cooled can be used for drying purposes, but the arrangements and apparatus required in connection herewith are expensive and render the process more complicated because, among other things, there is formed an accumulating circuit for undesirable volatile impurities, such as fluorine, chlorine and sulphur dioxide.

The object of the present invention is to provide a novel and advantageous method in which the aforementioned disadvantages are at least substantially eliminated.

To this end it is proposed in accordance with the invention that in a method of the kind mentioned in the introduction at least the first part of the drying operation is effected with heat stored in the conveyor and/or in a hearth layer arranged on said conveyor between the latter and the pellet bed by using a drying gas comprising substantially cool air which during its passage through the conveyor and/or the hearth layer is heated thereby to the temperature necessary to effect said at least first part of the drying operation. Suitably the drying gas is atmospheric air, or air which has been pre-heated to a temperature of at most 100° C. In this way the advantage is gained whereby the conveyor and the optional hearth layer pass in a relatively cool state to subsequent temperature-increasing treatment stages, whereby the hot gases flowing downardly through the pellet bed in these stages depart from the underside of the upper part of the conveyor at a moderate temperature and therewith at a moderate volume. By using cool air for at least the first part of the drying operation further advantages are gained in so much as only a relatively small volume of air is required and a fan constructed for low temperatures can be used. Thus, in this way there need only be used relatively small and inexpensive fans which do not need to be burdened with temperature controlling air. The energy costs are considerably reduced as a result hereof. Thus, when carrying out the method according to the invention the costs of electrical energy per ton of sintered pellets can be reduced by about 25%, while simultaneously decreasing investment costs for the sintering plant as a whole.

In order to avoid exaggerated lowering of the conveyor temperature at the out-feed end of the conveyor, the last treatment step carried out on the conveyor can suitably be effected with a gas flowing downwardly through the pellet bed and the conveyor. When using a hearth layer, the undermost layer of the bed can be separated at the out-feed end of the conveyor and the material thus separated from the bed can be returned as a hearth layer to the infeed end of the conveyor, optionally after screening said material to remove oversized and undersized particles therefrom. The method according to the invention also includes the use of a foreign material for the hearth layer, for example an inert ceramic material, which is constantly circulated.

When all the steps of the method according to the invention are carried out on a conveyor in, for instance, a belt sintering machine, structural simplifications can be achieved, and therewith lower investment costs, if, in accordance with an alternative advantageous embodiment, the last treatment step carried out on the conveyor is effected with a gas flowing upwardly through the conveyor and the bed, and the uppermost layer of the bed is separated at the out-feed end of the conveyor and said uppermost layer is returned in a hot state to the infeed end of the conveyor to form a hearth layer. In this method of procedure, only pellets sintered in the sintering apparatus are used in the conveyor system as hearth layer material, it being necessary for said material to withstand being re-heated.

According to an advantageous embodiment of the invention, gas is separated from the last part of the heating operation carried out on the conveyor and is separated from the sintering apparatus and subjected to a separate purifying process. By means of the method according to the invention, heat is recovered, as beforementioned, in an effective manner, so that gas from the last part of the heating operation carried out on the conveyor has a relatively low temperature, which temperature can be adjusted to any level whatsoever by suitably adapting the thermal capacity of the conveyor and the hearth layer. When applying this lastmentioned method of procedure the temperature level is suitably adjusted so that a substantial part of the troublesome impurities, such as $SO_2$, HCl and HF, depart with the separated gas; in this way the advantage is gained whereby circulation of these impurities in the sintering apparatus is greatly avoided and whereby the impurities are obtained in a relatively concentrated form in a relatively small quantity of gas, which can readily be purified.

The invention will now be described with reference to the accompanying drawing.

Figure 1:
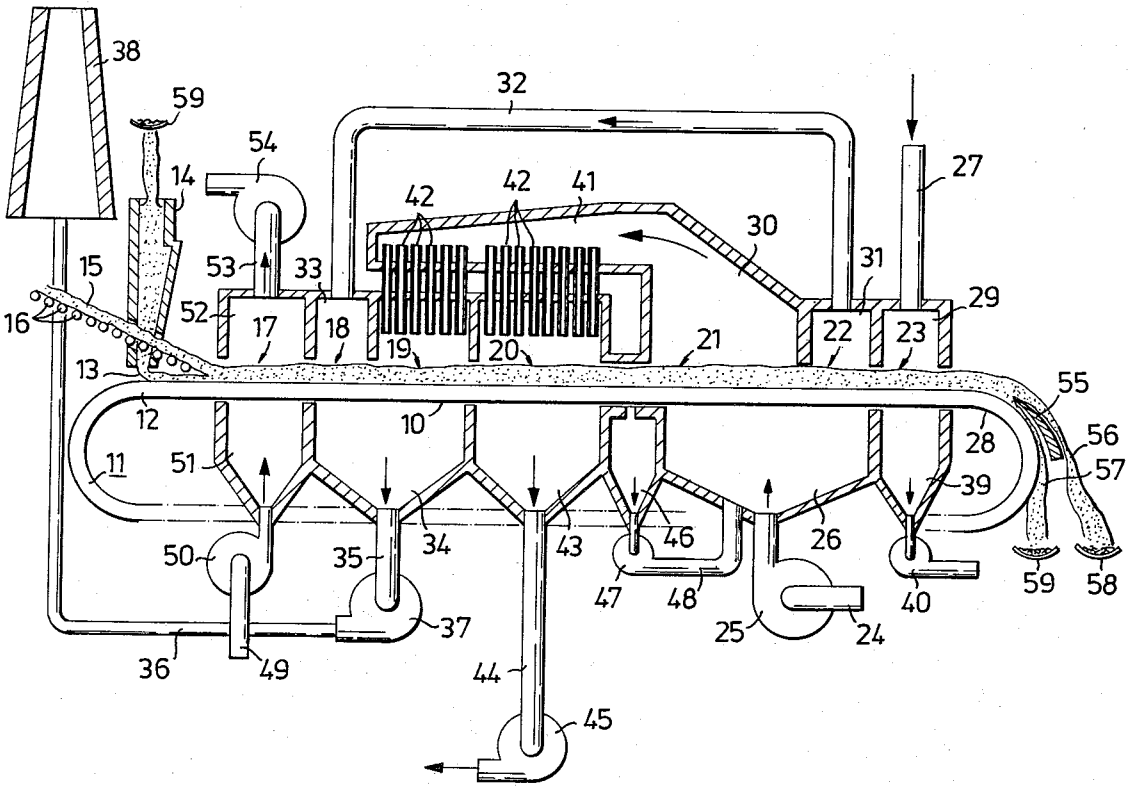
FIG. 1 illustrates schematically a belt sintering apparatus for carrying out the method according to the invention.

The apparatus illustrated in FIG. 1 comprises a movable grate 10 which comprises the upper horizontal part of an endless gas-permeable conveyor 11, said conveyor being preferably shielded and insulated in its entirety from the ambient atmosphere. Supplied to the infeed part 12 of the grate 10 from a bunker 14 is a relatively thin hearth layer 13 of relatively strong pellets, while a relatively thick upper layer 15 of agglomerated material is fed to said infeed part 12 by means of a conveyor 16, said agglomerated material having the form of moist green pellets or raw pellets which have been formed by a pelletizing process and which are to be fired in the apparatus. The grate conveys the bed comprising the pellet layers through pre-drying and final-drying zones 17, 18, pre-heating and final-heating zones 19, 20 and pre-cooling and final-cooling zones 21, 22 and 23 respectively. In the pre-drying zone 17 and the cooling zones 21, 22, 23 the green pellets are pre-dried and the pellet bed cooled by means of a gas passing upwardly through the grate 10 and the pellet bed, and the pellet bed is pre-heated and finally-heated in the pre-heating and final-heating zones 19, 20 respectively for the purpose of firing dried pellets, by means of a gas passing downwardly through the pellet bed and the grate. The pre-cooling gas used comprises air, which is passed to a pressure chamber 26 located beneath the grate 10 via a line 24 and a fan 25, and the final-cooling gas is also air which is passed to a pressure chamber 29 located above the grate 10 adjacent its outfeed end 28, via a line 27. Arranged on the side of the grate opposite the pressure chamber 26 are collecting chambers 30, 31 for collecting the air used in the pre-cooling step, said collecting chambers being mutually separated by depending partition. The heated, but relatively pure air used for the latter part of the pre-cooling step is used as the final-drying gas and is passed, via a line 32, to a pressure chamber 33 located above the final-drying zone 18, from which chamber the air is passed through the grate 10 and the pellet bed to a suction or collecting chamber 34, together with pre-heated gases from the zone 19. The gas used for the final-drying and pre-heating steps is removed from the collecting chamber 34 by suction and passed to a chimney 38 via lines 35, 36 and a fan 37. The substantially pure gas used for the final-cooling step is passed through the pellet bed and the grate to a suction chamber 39, from where the air is removed by suction by means of a fan 40 and allowed to pass to atmosphere, optionally via the chimney 38.

The air used for the first part of the pre-cooling step departs through a main line 41 and distributing lines 42 to the pre-heating and final-heating zones 19, 20, where said air is used as secondary air for burners (not shown), said burners being arranged above the pellet bed and generating hot combustion gases intended for the pre-heating and final-heating steps. Above the grate 10 the pre-heating and final-heating zones 19, 20 are separated from one another and from the final-drying and pre-cooling zones 18, 21 by means of depending partitions. Arranged beneath the grate 10, between the pressure chamber 26 and the suction chamber 34, is a suction chamber 43 which is connected, via a line 44, to the suction side of a fan 45, said fan being arranged to transport the gas used for final heating and sintering in the zone 20 to a gas-purifying apparatus not shown.

Arranged between the chambers 43 and 26 is a sealing zone which comprises a chamber 46 located on the underside of the grate, said chamber communicating via one or more relatively small openings (in the illustrated embodiment a narrow slot) with the grate 10 and being in other respect mechanically screened from the underside of said grate by means of horizontal plates, as indicated on the drawing. The chamber 46 is connected to the suction side of a fan 47, wherewith gas is removed from the chamber 46 by suction in a manner so controlled that there is maintained therein a pressure which is substantially equal to the pressure in that part 43 of the adjacent final-heating zone 20 which is located beneath the grate 10. The gas removed from the chamber 46 is fed from the fan 47 to the pressure chamber 26 via a line 48.

The pre-drying step is carried out with atmospheric air, which is passed to a pressure chamber 51 located beneath the grate 10 via a line 49 and a fan 50. The air passes from the chamber 51 through the grate 10, said air being heated by the heat stored in the grate and the hearth layer material while cooling the grate, and up through the bed while pre-drying the moist pellets forming the layer 15. The air used for the pre-drying step is collected in a suction chamber 52 and is led away via a line 53 and a fan 54.

The temperatures of respective zones 19 and 20 are suitably adapted in a manner such that impurities released during the sintering process, such as gaseous impurities containing sulphur, fluorine and chlorine, depart only in the zone 20, so that acceptable environmental conditions can be maintained solely by cleaning the gas collected in the suction chamber 43.

Arranged at the outfeed end 28 of the grate 10 is a separating means 55 which, in the illustrated embodiment, has the form of a blade extending transversely of the grate, said blade being so positioned relative to the surface of the grate that it divides the bed into a layer 56 which comprises substantially solely sintered product pellets originating from the pellet layer 15, and a layer 57 which comprises substantially solely material originating from the hearth layer 13. The layers 56 and 57 are passed to a respective conveyor 58 and 59 respectively for transport to a pellet-storage station and for transport, in a hot state, back to the bunker 14 for hearth-layer material, for which purpose a further part of the conveyor 59 is located above the bunker 14 in FIG. 1.

Separation of the hearth layer from the sintered product pellets can be effected in any suitable manner, and hence the invention is not restricted to the use of the illustrated blade 55 for dividing the bed into layers of pellets and hearth-layer material.

The illustrated arrangement in which hearth-layer material is circulated in the apparatus can be used to particular advantage when sintering basic iron-ore pellets and other pellets which cannot be re-heated without suffering damage.

Figure 2:
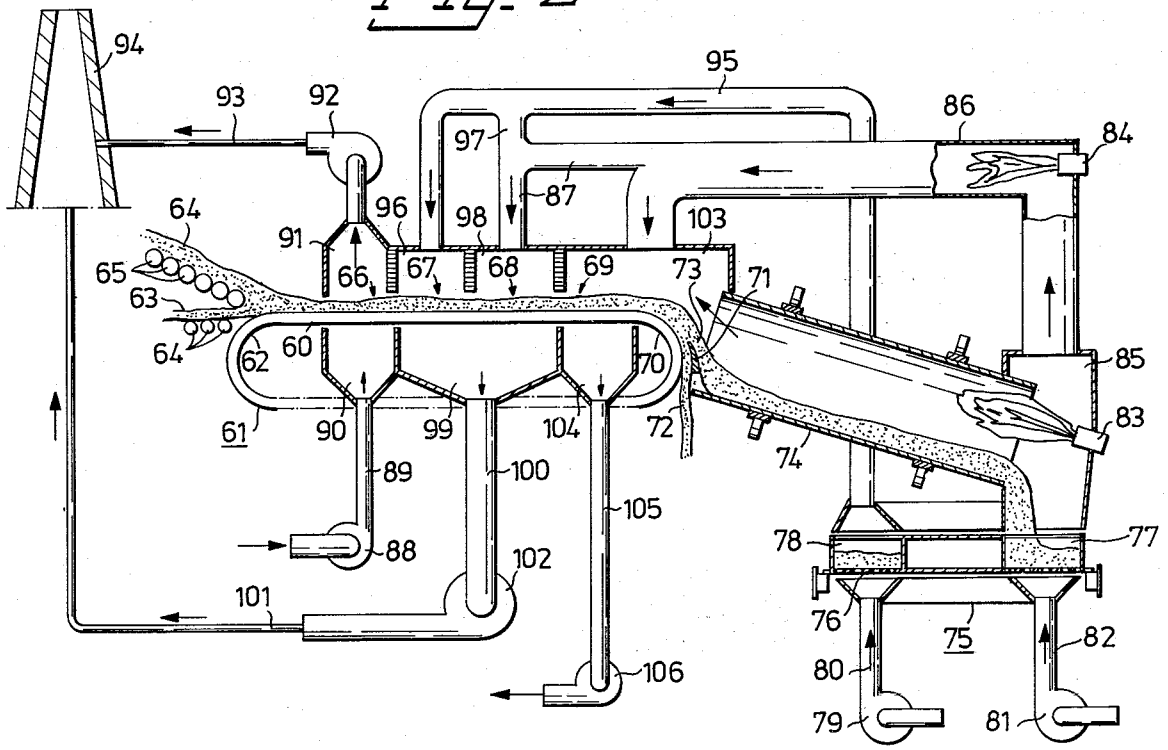
FIG. 2 illustrates schematically a combined belt and rotary kiln apparatus for carrying out the method according to the invention.

The apparatus illustrated in FIG. 2 comprises a movable grate 60 which is formed by the upper part of an endless, gas-permeable conveyor 61 shielded from the ambient atmosphere. Fed to the infeed part 62 of the grate 60 is a hearth layer 63 of durable pellets, and an upper layer 64 of agglomerate material in the form of moist green pellets or raw pellets which have been formed by a pelletizing process and which are to be fired in said apparatus, the hearth-layer material being supplied by means of a conveyor 64, and said green pellets being supplied by means of a further conveyor 65. The grate 60 conveys the bed formed by the pellets and the hearth layer through pre-drying and final-drying zones 66, 67 and pre-heating and final-heating zones 68, 69. Arranged at the outfeed end 70 of the grate 60 is a separating means 71, by which the finally heated material is divided into a bottom layer 72, which comprises substantially solely material originating from the hearth layer 63, and an upper layer 73, which comprises substantially solely pellets originating from the green-pellet layer 64. The bottom layer 72 is returned, suitably in a hot state, to the conveyor 64 by means of means not shown for re-use as a hearth layer, while the top layer 73 is passed to an inclined, rotary kiln 74 in which the temperature of the pellets formed by the layer 73 is equilized and said pellets are optionally finally fired. The fired pellets are passed from the lower end of the rotary kiln 74 to a cooler 75, said cooler 75 and the rotary kiln 74 being shielded from ambient atmosphere.

The cooler 75 of the illustrated embodiment is provided with a ring-shaped, movable gas-permeable grate 76 and is divided by partitions (not shown) into a primary cooling zone 77, into which pellets fed out from the rotary furnace 74 are introduced and pre-cooled during transport of said pellets on the grate 76 to a secondary cooling zone 78, in which the pre-cooled pellets are finally cooled with pure air, which is passed to said zone 78 by means of a fan 79 and a line 80. The pellets are passed further on the grate 76 from the secondary cooling zone 78 to an outfeed zone (not shown), from where fired and cooled pellets are removed in a suitable manner, not shown. The pre-cooling step is also carried out with substantially pure air, which is introduced by means of a fan 81 and a line 82. The primary and secondary cooling air is passed to the lower side of the cooling grate 76, and passes up through said grate and the pellet bed resting thereon.

Process gas intended for the firing process is generated by burning fuel in the apparatus, using a burner arrangement comprising burners 83, 84 primary cooling air used in the cooler 75 being used by said burner arrangement as secondary air. For the sake of simplicity, the fuel inlet lines and primary air lines of the burners 83, 84 have not been shown. The process or combustion gas generated by the burners 83, 84 is passed to the part of the plant preceding the rotary kiln 74, where the gas for finally drying, heating and firing the pellets is passed through the grate and the bed transported thereon in a manner hereinafter described. As previously mentioned, the temperature of the pellets is equilized in the rotary kiln 74, together with optional final firing of said pellets. For this purpose, only a relatively small amount of the total amount of combustion gas required for the sintering process is utilized. In order to keep the diameter of the rotary kiln within reasonable limits, there is arranged a by-pass system comprising a hood 85 and lines 86, 87, in which by-pass system part of the requisite process or combustion gas is generated by means of the burner 84. The burner 84, which uses air arriving from the primary cooling zone 77 as secondary air, can therewith be arranged to generate the major part of the hot gas required for the sintering process.

In the part of the plant preceding the rotary kiln 74 the pre-drying step is effected with atmospheric air which is supplied to a pressure chamber 90 located beneath the grate, by means of a fan 88 and a line 89, from which chamber said air passes through the grate 60 and the bed formed by hearth-layer 63 and green-pellet layers 64, to a suction chamber 91, from whence the air used for pre-heating purposes, departs to a chimney 94, via a fan 92 and a line 93. During its passage through the grate 60 and the hearth-layer 63, the air arriving from the pressure chamber 90 is heated to a temperature suitable for pre-drying purposes by the heat stored in the grate and the hearth-layer, whereby said grate is cooled in a manner desired. For the final-drying step there is used hot air which was previously used for finally cooling the sintered pellets in the cooling zone 78 of the cooler 75. Hot, but substantially pure air, used in the final cooling zone 78 passes through a line 95 to a pressure chamber 96 located above the final drying zone 67. For pre-heating material in the zone 68 there is used partly the combustion gas passing through the line 87 and generated by the burner 84 and partly a portion of the air arriving from the final cooling zone 78, which air is passed to the line 87 through a line 97 branching from the line 95. The line 87 opens out into a pressure chamber 98 located in the zone 68 above the grate 60, from which pressure chamber the pre-heating gas passes through the pellet bed and the grate to a gas-collecting chamber 99, common to the zones 67 and 68. Gas is passed from the gas-collecting chamber to the chimney 94 via lines 100, 101 and a fan 102.

A considerable part of the combustion gas generated by the burner 84 and passing through the line 86, and all of the combustion gas generated by the burner 83 and arriving from the rotary furnace 74 is led to a chamber 103 located in the final-heating zone 69 above the grate 60, from which chamber the gas is passed through the pellet bed and the grate to a gas-collecting chamber 104 arranged beneath said grate. The gas is led from the chamber 104 to a gas-purifying plant (not shown) by means of a line 105 and a fan 106. The gas flow and the temperature of the combustion gases air adjusted so that impurities released during the sintering process, such as impurities containing gaseous sulphur, fluorine and chlorine, depart substantially only at the zone 69, so that acceptable environmental conditions can be maintained solely by purifying the gas collected in the chamber 104.

No system for controlling the various fans in a manner such as to maintain in the apparatus the flow pattern described and illustrated by the arrows has been shown or described, since such a system does not form part of the invention. Furthermore, such systems are previously known in all essential details.

The invention is not limited to the aforedescribed and illustrated embodiments, but can be modified within the scope of the following claims. Thus, no hearth layer need be used, and the air used for pre-drying purposes may be heated to drying temperature solely by the heat stored in the grate. Alternatively, when using a hearth layer, there can be used a lightweight conveyor, for example a conveyor having the form of a perforated steel belt, with small thermal capacity, and the air used for pre-drying purposes can be heated to the drying temperature solely by the heat stored in a hearth layer comprising hot re-circulated hearth-layer material.

I claim:

1. A method of sintering green iron ore pellets, comprising the steps of drying, pre-heating, firing and cooling said pellets, in which at least the drying and pre-heating steps are carried out with said pellets resting in the form of a bed on an endless gas-permeable conveyor, and in which at least a first part of the drying operation is effected with a gas passing upwardly through the conveyor and the pellet bed, while subsequent temperature-increasing treatment steps carried out on the conveyor are effected with a hot gas passing downwardly through the pellet bed and the conveyor, said at least first part of the drying operation is carried out with heat stored in the conveyor, in a hearth-layer arranged on said conveyor between the latter and the pellet bed or in the conveyor and the hearth-layer by using a drying gas comprising air having, when passing upwardly into the conveyor at the first part of where said drying operation is effected, a temperature of at most 100° C. and which air during its passage through the conveyor, the hearth-layer or the conveyor and the hearth-layer is heated thereby to the temperature necessary to effect said at least first part of the drying operation.

2. A method according to claim 1, wherein said drying gas comprises atmospheric air.

3. A method according to claim 1, wherein a last treatment step carried out on the conveyor is effected with a gas flowing downwardly through the bed and the conveyor.

4. A method according to claim 3, wherein a lowermost layer of the bed is separated at an out-feed end of the conveyor and is returned, in a hot state, as a hearth-layer to an in-feed end of the conveyor.

5. A method according to claim 1, wherein a last treatment step carried out on an conveyor is effected with a gas flowing upwardly through the conveyor and the bed; and in that a uppermost layer of the bed is separated at the out-feed end of a conveyor and is returned in a hot state as a hearth-layer to an in-feed end of the conveyor.

6. A method according to any one of claim 1, wherein gas from a last part of the heating operation carried out on the conveyor is separated from the sintering apparatus and is subjected to a separate purifying process.

* * * * *

UNITED STATES PATENT AND TRADEMARK OFFICE

CERTIFICATE OF CORRECTION

PATENT NO. : 4,321,085

DATED : March 23, 1982

INVENTOR(S) : Roland DRUGGE

It is certified that error appears in the above—identified patent and that said Letters Patent is hereby corrected as shown below:

On the title page the following is corrected to read:

--[73] Assignee: Luossavaara-Kiirunavaara Aktiebolag, Stockholm, Sweden--.

Signed and Sealed this

*Fifth* Day of *October 1982*

[SEAL]

*Attest:*

*Attesting Officer*

GERALD J. MOSSINGHOFF

*Commissioner of Patents and Trademarks*